US009200426B2

(12) United States Patent
Hayashi et al.

(10) Patent No.: US 9,200,426 B2
(45) Date of Patent: Dec. 1, 2015

(54) BLADE CONTROL SYSTEM AND CONSTRUCTION MACHINE

(71) Applicant: KOMATSU LTD., Tokyo (JP)

(72) Inventors: Kazuhiko Hayashi, Komatsu (JP); Kenji Okamoto, Hiratsuka (JP); Kenjiro Shimada, Komatsu (JP)

(73) Assignee: KOMATSU LTD., Tokyo (JP)

( * ) Notice: Subject to any disclaimer, the term of this patent is extended or adjusted under 35 U.S.C. 154(b) by 42 days.

(21) Appl. No.: 14/176,355

(22) Filed: Feb. 10, 2014

(65) Prior Publication Data

US 2014/0151074 A1 Jun. 5, 2014

Related U.S. Application Data

(63) Continuation of application No. 13/249,792, filed on Sep. 30, 2011, now Pat. No. 8,731,784.

(51) Int. Cl.

| | |
|---|---|
| ***E02F 3/85*** | (2006.01) |
| ***E02F 3/84*** | (2006.01) |
| ***E02F 3/76*** | (2006.01) |

(52) U.S. Cl.

CPC ..... *E02F 3/844* (2013.01); *E02F 3/7609* (2013.01); *E02F 3/7618* (2013.01); *E02F 3/845* (2013.01)

(58) Field of Classification Search

CPC ..... E02F 3/76; E02F 3/7609; E02F 3/769; E02F 3/7695; E02F 9/2029; E02F 9/2041

USPC ..... 701/50; D15/10, 23, 25; 172/810, 811, 172/818, 822, 823, 824, 701.1

See application file for complete search history.

(56) References Cited

U.S. PATENT DOCUMENTS

| | | | | | |
|---|---|---|---|---|---|
| 4,630,685 | A | * | 12/1986 | Huck et al. | 172/7 |
| 4,807,131 | A | * | 2/1989 | Clegg | 701/50 |
| 5,375,663 | A | * | 12/1994 | Teach | 172/4.5 |
| 5,621,643 | A | | 4/1997 | Nakagami et al. | |
| 5,951,613 | A | | 9/1999 | Sahm et al. | |
| 6,068,060 | A | | 5/2000 | Ohtomo et al. | |
| 6,112,145 | A | * | 8/2000 | Zachman | 701/50 |
| 6,181,999 | B1 | * | 1/2001 | Yamamoto et al. | 701/50 |

(Continued)

FOREIGN PATENT DOCUMENTS

| | | | |
|---|---|---|---|
| JP | 61-500449 | A | 3/1986 |
| JP | 5-106239 | A | 4/1993 |

(Continued)

OTHER PUBLICATIONS

The International Search Report for the corresponding international application No. PCT/JP2012/073136, issued on Oct. 23, 2012.

*Primary Examiner* — Thomas G Black
*Assistant Examiner* — Sara Nelson
(74) *Attorney, Agent, or Firm* — Global IP Counselors, LLP

(57) ABSTRACT

A blade control system includes an angle obtaining part, an open ratio setting part and a lift cylinder controlling part. The angle obtaining part is configured to obtain an angle of a lift frame with respect to a designed surface. The open ratio setting part is configured to set an open ratio based on the angle. The lift cylinder controlling part is configured to open a proportional control valve at the open ratio for elevating the blade when a distance between the designed surface and an edge of a blade is determined to be less than or equal to a threshold.

9 Claims, 9 Drawing Sheets

(56) References Cited

U.S. PATENT DOCUMENTS

| | | | | |
|---|---|---|---|---|
| 6,191,732 | B1 * | 2/2001 | Carlson et al. | 342/357.3 |
| 6,317,676 | B1 * | 11/2001 | Gengler et al. | 701/82 |
| 6,655,465 | B2 * | 12/2003 | Carlson et al. | 172/4.5 |
| 7,121,355 | B2 * | 10/2006 | Lumpkins et al. | 172/4.5 |
| 7,293,376 | B2 * | 11/2007 | Glover | 37/414 |
| 7,317,977 | B2 * | 1/2008 | Matrosov | 701/50 |
| 7,588,088 | B2 * | 9/2009 | Zachman | 172/4.5 |
| 7,734,398 | B2 * | 6/2010 | Manneppalli | 701/50 |
| 7,949,449 | B2 * | 5/2011 | Koch et al. | 701/50 |
| 8,065,060 | B2 * | 11/2011 | Danko | 701/50 |
| 8,090,508 | B2 * | 1/2012 | Beese | 701/50 |
| 8,145,355 | B2 * | 3/2012 | Danko | 700/251 |
| 8,145,391 | B2 * | 3/2012 | Omelchenko et al. | 701/50 |
| 8,275,524 | B2 * | 9/2012 | Krause et al. | 701/50 |
| 2006/0041361 | A1 * | 2/2006 | Matrosov | 701/50 |
| 2008/0109141 | A1 * | 5/2008 | Nichols et al. | 701/50 |
| 2008/0275596 | A1 * | 11/2008 | Tarasinski et al. | 701/1 |
| 2009/0112410 | A1 * | 4/2009 | Shull | 701/50 |
| 2009/0159302 | A1 * | 6/2009 | Koch et al. | 172/2 |
| 2009/0187315 | A1 * | 7/2009 | Yegerlehner et al. | 701/50 |
| 2009/0313860 | A1 * | 12/2009 | Breiner et al. | 37/301 |
| 2010/0031538 | A1 | 2/2010 | Hall | |
| 2010/0121540 | A1 * | 5/2010 | Kumagai et al. | 701/50 |
| 2010/0162885 | A1 | 7/2010 | Hughes, IV et al. | |
| 2010/0299031 | A1 * | 11/2010 | Zhdanov et al. | 701/50 |
| 2011/0091308 | A1 * | 4/2011 | Nichols | 414/698 |
| 2012/0239258 | A1 * | 9/2012 | Konno et al. | 701/50 |
| 2012/0253609 | A1 * | 10/2012 | Li et al. | 701/50 |

FOREIGN PATENT DOCUMENTS

| | | | |
|---|---|---|---|
| JP | 10-141955 | A | 5/1998 |
| JP | 11-256620 | A | 9/1999 |
| JP | 2001-500937 | A | 1/2001 |

* cited by examiner

BLADE CONTROL SYSTEM AND CONSTRUCTION MACHINE

CROSS-REFERENCE TO RELATED APPLICATIONS

This application is a continuation application of U.S. patent application Ser. No. 13/249,792 filed on Sep. 30, 2011.

BACKGROUND

1. Technical Field

The present invention relates to a blade control system and a construction machine for causing a cutting edge of a blade to move across a designed surface.

2. Background Art

A method of holding a cutting edge of a blade in a desired position have been proposed for construction machines (bulldozers, graders and etc.), the method is configured to cause a level sensor disposed above the blade to detect a laser beam and regulate the position of the laser beam detected by the level sensor to be matched with a predetermined position (e.g., see Japan Laid-open Patent Application Publication No. JP-A-H11-256620). The publication No. JP-A-H11-256620 describes that the method enables the cutting edge of the blade to automatically move across a designed surface having a predetermined shape by arbitrarily adjusting an emission direction of the laser beam. It should be noted that the designed surface herein refers to a three-dimensionally designed landform indicating a target shape of an object for dozing.

SUMMARY

In the method described in the publication No. JP-A-H11-256620, the blade is configured to be elevated or lowered every time the position of the detected laser beam is displaced from the predetermined position. Therefore, the blade edge may be shoved across the designed surface into the object for dozing when the blade is largely lowered in response to the position of the detected laser beam that is largely displaced downwards from the predetermined position.

Specifically in dozing the ground by largely lowering the blade, the position of the detected laser beam is abruptly displaced upwards from the predetermined position the minute the construction machine enters a slope formed by dozing with the blade. In response, elevation of the blade is started, but the blade is herein deeply stuck into the object for dozing, then it takes a considerable time to regulate again the position of the detected laser beam with the predetermined position and the designed surface is roughened by the blade edge of the blade. It is thus difficult to cause the cutting edge of the blade to accurately move across the designed surface in the method described in the publication No. JP-A-H11-256620.

The present invention has been produced in view of the above drawback and is intended to provide a blade control system and a construction machine for causing the cutting edge of the blade to accurately move across the designed surface.

A blade control system according to a first aspect of the present invention includes a lift frame vertically pivotably attached to a vehicle body; a blade supported by a tip of the lift frame and extending in a right-and-left direction of the vehicle body; a lift cylinder configured to vertically pivot the lift frame; a proportional control valve connected to the lift cylinder; an angle obtaining part configured to obtain an angle of the lift frame with respect to a designed surface in a side view of the vehicle body, the designed surface formed as a three-dimensionally designed landform indicating a target contour of an object for dozing; an open ratio setting part configured to set an open ratio of the proportional control valve based on the angle; a distance calculating part configured to calculate a distance between the designed surface and a cutting edge of the blade; a determining part configured to determine whether or not the distance between the designed surface and the cutting edge of the blade is less than or equal to a threshold; and a lift cylinder controlling part configured to open the proportional control valve at the open ratio set by the open ratio setting part for elevating the blade when the determining part determines that the distance between the designed surface and the cutting edge of the blade is less than or equal to the threshold.

According to the blade control system of the first aspect of the present invention, the open ratio of the proportional control valve is set based on the angle of the lift frame with respect to the designed surface. It is thereby possible to increase the speed for elevating the blade in inverse proportion to the vertical position of the blade by setting the open ratio to be increased in proportion to magnitude of the angle. Even when the cutting edge of the blade is shoved deeply into an object for dozing, it is possible to inhibit the cutting edge of the blade from being shoved across the designed surface into the object for dozing due to delay of the timing of elevating the blade. According to the blade control system of the first aspect of the present invention, it is thus possible to cause the cutting edge of the blade to accurately move across the designed surface.

In a blade control system according to a second aspect of the present invention relates to the blade control system according to the first aspect, the open ratio setting part is configured to increase the open ratio of the proportional control valve in proportion to magnitude of the angle of the lift frame with respect to the designed surface.

According to the blade control system of the second aspect of the present invention, it is possible to increase the speed for elevating the blade in proportion to depth of the cutting edge of the blade shoved across the designed surface into an object for dozing. It is consequently possible to inhibit the cutting edge of the blade from being shoved across the designed surface into the object for dozing due to delay of the timing of elevating the blade.

In a blade control system according to a third aspect of the present invention relates to the blade control system according to the second aspect, the open ratio setting part is configured to fix the open ratio of the proportional control valve to be a maximum value when the angle of the lift frame with respect to the designed surface is greater than or equal to a predetermined value.

A blade control system according to a fourth aspect of the present invention relates to the blade control system according to the first aspect further includes a speed obtaining part which is configured to obtain a speed of the cutting edge of the blade approaching the designed surface in a direction perpendicular to the designed surface, and a threshold setting part which is configured to increase the threshold in proportion to magnitude of the speed.

According to the blade control system of the fourth aspect of the present invention, it is possible to set ahead the timing of starting elevation of the blade in proportion to magnitude of the speed of the blade approaching the designed surface. It is thereby possible to inhibit the cutting edge of the blade from being shoved across the designed surface into an object for dozing even when the distance between the designed surface and the cutting edge of the blade is abruptly reduced. According to the blade control system of the fourth aspect of the present invention, it is thus possible to cause the cutting edge of the blade to more accurately move across the designed surface.

In a blade control system according to a fifth aspect of the present invention relates to the blade control system according to the fourth aspect, the threshold setting part is configured to fix the threshold to be a maximum value when the speed is greater than or equal to a predetermined value.

In a blade control system according to a sixth aspect of the present invention relates to the blade control system according to the first aspect, the lift cylinder controlling part is configured to prevent elevation of the blade when the lift frame is positioned higher than a predetermined position.

According to the blade control system of the six aspect of the present invention, it is possible to execute the control of setting ahead the timing of starting elevation of the blade only when chances are that the cutting edge of the blade is shoved across the designed surface in an object for dozing. It is thereby possible to inhibit the control of setting ahead the timing of starting elevation of the blade from being excessively executed.

A blade control system according to a seventh aspect of the present invention relates to the blade control system according to the first aspect further includes a blade load obtaining part which is configured to obtain a load acting on the blade and a storage part which is configured to store a target load preliminarily set, the lift cylinder controlling part is configured to control the open ratio of the proportional control valve for allowing the load to get closer to the target load when the determining part determines that the distance between the designed surface and the cutting edge of the blade is greater than the threshold.

According to the blade control system of the seventh aspect of the present invention, the target load has been preliminarily set in consideration of the balance between the dozing amount of soil and shoe slippage of tracks of the drive unit against the ground (hereinafter referred to as "shoe slippage"), then a dozing work can be done while excessive shoe slippage is inhibited and a dozing amount of soil is sufficiently maintained.

It should be noted that the aforementioned excessive shoe slippage refers to a state that the driving force of the drive unit is prevented from being appropriately transferred to the ground due to an excessive amount of slippage of the tracks of the drive unit against the ground.

A construction machine according to an eighth aspect of the present invention includes a vehicle body and the blade control system according to the first aspect of the present invention.

A construction machine according to a ninth aspect of the present invention relates to the construction machine according to the eighth aspect of the present invention. The construction machine further includes a drive unit. The drive unit includes a pair of tracks attached to the vehicle body.

Overall, according to the present invention, it is possible to provide a blade control system and a construction machine for causing a cutting edge of a work implement to accurately move across a designed surface.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

With reference to attached figures, a bulldozer will be hereinafter explained as an exemplary "construction machine". In the following explanation, the terms "up", "down", "front", "rear", "right" and "left" and their related terms should be understood as directions seen from an operator seated on an operator's seat.

Overall Structure of Bulldozer 100

Figure 1:
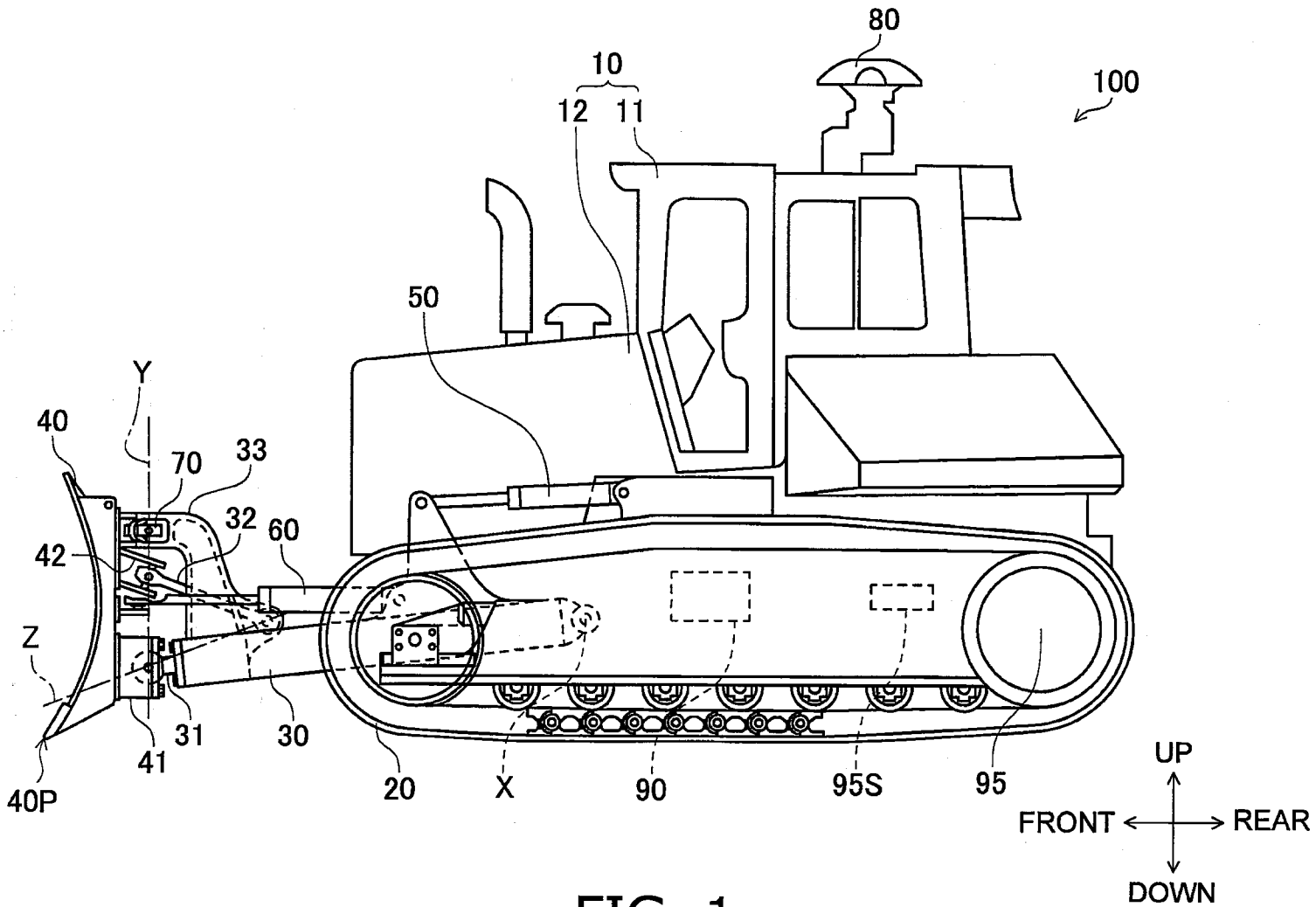
FIG. 1 is a side view of the entire structure of a bulldozer.

FIG. 1 is a side view of the entire structure of a bulldozer 100 according to an exemplary embodiment of the present invention.

The bulldozer 100 includes a vehicle body 10, a drive unit 20, a lift frame 30, a blade 40, a lift cylinder 50, a angling cylinder 60, a tilt cylinder 70, a GPS receiver 80, an IMU (Inertial Measurement Unit) 90, a pair of sprocket wheels 95 and a driving torque sensor 95S. Further, the bulldozer 100 is embedded with a blade control system 200. The structure and actions of the blade control system 200 will be hereinafter described.

The vehicle body 10 includes a cab 11 and an engine compartment 12. Although not illustrated in the figures, the cab 11 is equipped with a seat and a variety of operating devices. The engine compartment 12 is disposed forwards of the cab 11.

The drive unit 20 is formed by a pair of tracks (only the left-side one is illustrated in FIG. 1), and the drive unit 20 is attached to the bottom of the vehicle body 10. The bulldozer 100 is configured to drive when the pair of tracks is rotated in conjunction with driving of the pair of sprocket wheels 95.

The lift frame 30 is disposed inwards of the drive unit 20 in the right-and-left direction of the bulldozer 100. The lift frame 30 is attached to the vehicle body 10 while being up-and-down directionally pivotable about an axis X arranged in parallel to the right-and-left direction. The lift frame 30 supports the blade 40 through a ball-and-socket joint 31, a pitching support link 32 and a bracing strut 33.

The blade 40 is disposed forwards of the vehicle body 10. The blade 40 is supported by the lift frame 30 through a universal coupling 41 coupled to the ball-and-socket joint 31 and a pitching coupling 42 coupled to the pitching support link 32. The blade 40 is configured to be lifted up or down in conjunction with upward or downward pivot of the lift frame 30. The blade 40 includes a cutting edge 40P on the bottom end thereof. The cutting edge 40P is shoved into the ground in grading or dozing.

The lift cylinder 50 is coupled to the vehicle body 10 and the lift frame 30. In conjunction with extension or contraction of the lift cylinder 50, the lift frame 30 is configured to pivot up and down about the axis X.

The angling cylinder 60 is coupled to the lift frame 30 and the blade 40. In conjunction with extension or contraction of the angling cylinder 60, the blade 40 is configured to be tilted about an axis Y passing through the rotary center of the universal coupling 41 and that of the pitching coupling 42.

The tilt cylinder 70 is coupled to the bracing strut 33 of the lift frame 30 and the right upper end of the blade 40. In conjunction with extension or contraction of the tilt cylinder 70, the blade 40 is configured to rotate about an axis Z connecting the ball-and-socket joint 31 and the bottom end of the pitching support link 32.

The GPS receiver 80 is disposed on the cab 11. The GPS receiver 80 is a GPS (Global Positioning System) antenna. The GPS receiver 80 is configured to receive GPS data indicating the installation position thereof. The GPS receiver 80 is configured to transmit the received GPS data to a blade controller 210 (see FIG. 3) to be described.

The IMU 90 is configured to obtain vehicle body tilting angle data indicating tilting angles of the vehicle body in the longitudinal (front-and-rear) and transverse (right-and-left) directions. The IMU 90 is configured to transmit the vehicle body tilting angle data to the blade controller 210.

The pair of sprocket wheels 95 is configured to be driven by an engine (not illustrated in the figures) accommodated in the engine compartment 12. The drive unit 20 is configured to be driven in conjunction with driving of the pair of sprocket wheels 95.

The driving torque sensor 95S is configured to obtain driving torque data indicating driving torque of the pair of sprocket wheels 95. The driving torque sensor 95S is configured to transmit the obtained driving torque data to the blade controller 210.

Figure 2B:
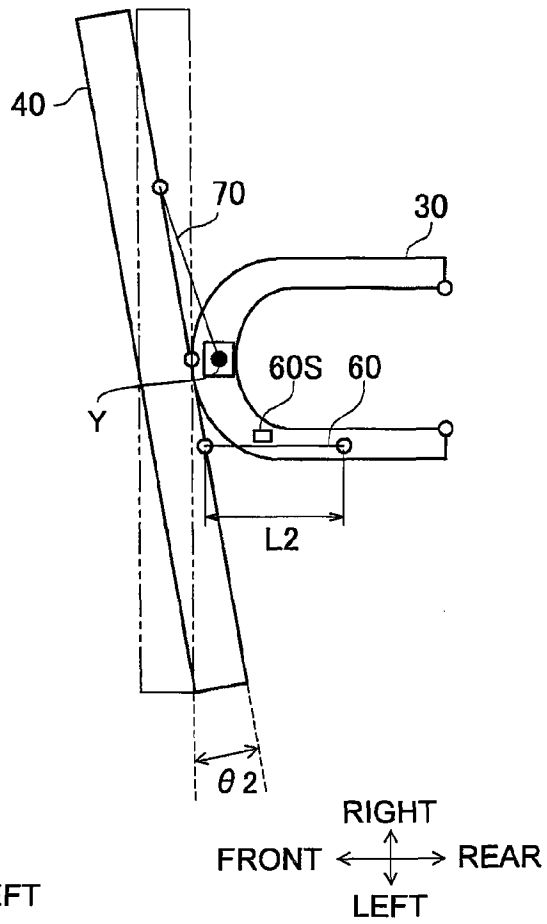
FIG. 2B is a top view of the blade.
Figure 2A:
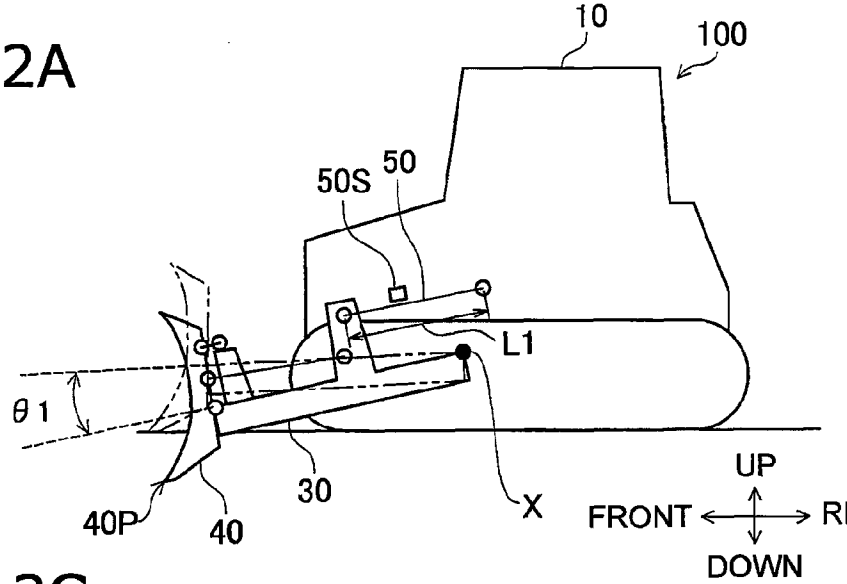
FIG. 2A is a side view of a blade.
Figure 2C:
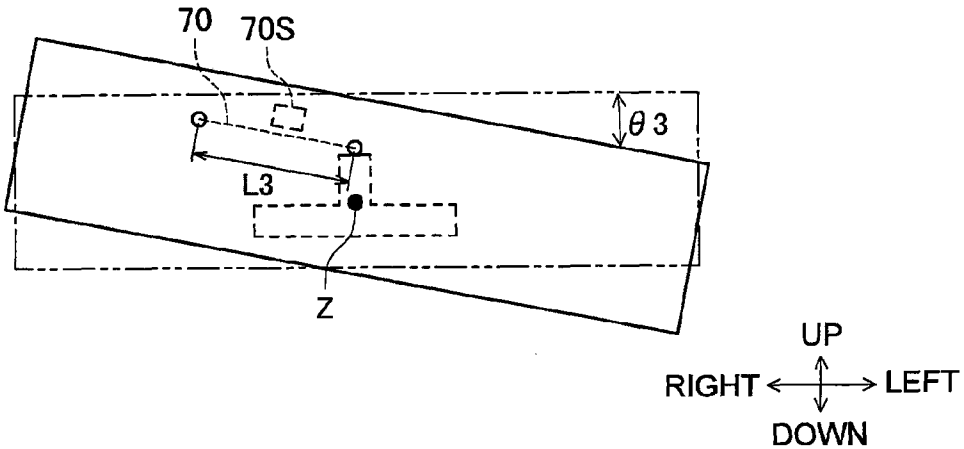
FIG. 2C is a front view of the blade.

Now, FIG. 2 is schematic configuration diagrams of the bulldozer 100. Specifically, FIG. 2A is a side view of the blade 40. FIG. 2B is a top view of the blade 40. FIG. 2C is a front view of the blade 40. In each of FIGS. 2A to 2C, an original position of the lift frame 30 is depicted with a dashed two-dotted line. When the lift frame 30 is positioned in the original position, the cutting edge 40P of the blade 40 is configured to make contact with the horizontal ground.

As illustrated in FIGS. 2A to 2C, the bulldozer 100 includes a lift cylinder sensor 50S, a angling cylinder sensor 60S and a tilt cylinder sensor 70S. Each of the lift cylinder sensor 50S, the angling cylinder sensor 60S and the tilt cylinder sensor 70S is formed by a rotatable roller which is configured to detect the position of a cylinder rod and a magnetic sensor which is configured to return the cylinder rod to the original position.

As illustrated in FIG. 2A, the lift cylinder sensor 50S is configured to detect the stroke length of the lift cylinder 50 (hereinafter referred to as "a lift cylinder length L1") and transmit the detected lift cylinder length L1 to the blade controller 210. The blade controller 210 is configured to calculate a blade lifting angle θ1 of the blade 40 based on the lift cylinder length L1. In the present exemplary embodiment, the blade lifting angle θ1 corresponds to a lowered angle of the blade 40 from the original position in a side view, i.e., the depth of the cutting edge 40P shoved into the ground. A method of calculating the blade lifting angle θ1 will be hereinafter described.

As illustrated in FIG. 2B, the angling cylinder sensor 60S is configured to detect the stroke length of the angling cylinder 60 (hereinafter referred to as "a angling cylinder length L2") and transmit the detected angling cylinder length L2 to the blade controller 210. As illustrated in FIG. 2C, the tilt cylinder sensor 70S is configured to detect the stroke length of the tilt cylinder 70 (hereinafter referred to as "a tilt cylinder length L3") and transmit the detected tilt cylinder length L3 to the blade controller 210. The blade controller 210 is configured to calculate a blade angling angle θ2 and a blade tilting angle θ3 of the blade 40 based on the angling cylinder length L2 and the tilt cylinder length L3.

It should be noted that applications of the blade lifting angle θ1 will be hereinafter mainly explained without explaining those of the blade angling angle θ2 and the blade tilting angle θ3.

Structure of Blade Control System 200

Figure 3:
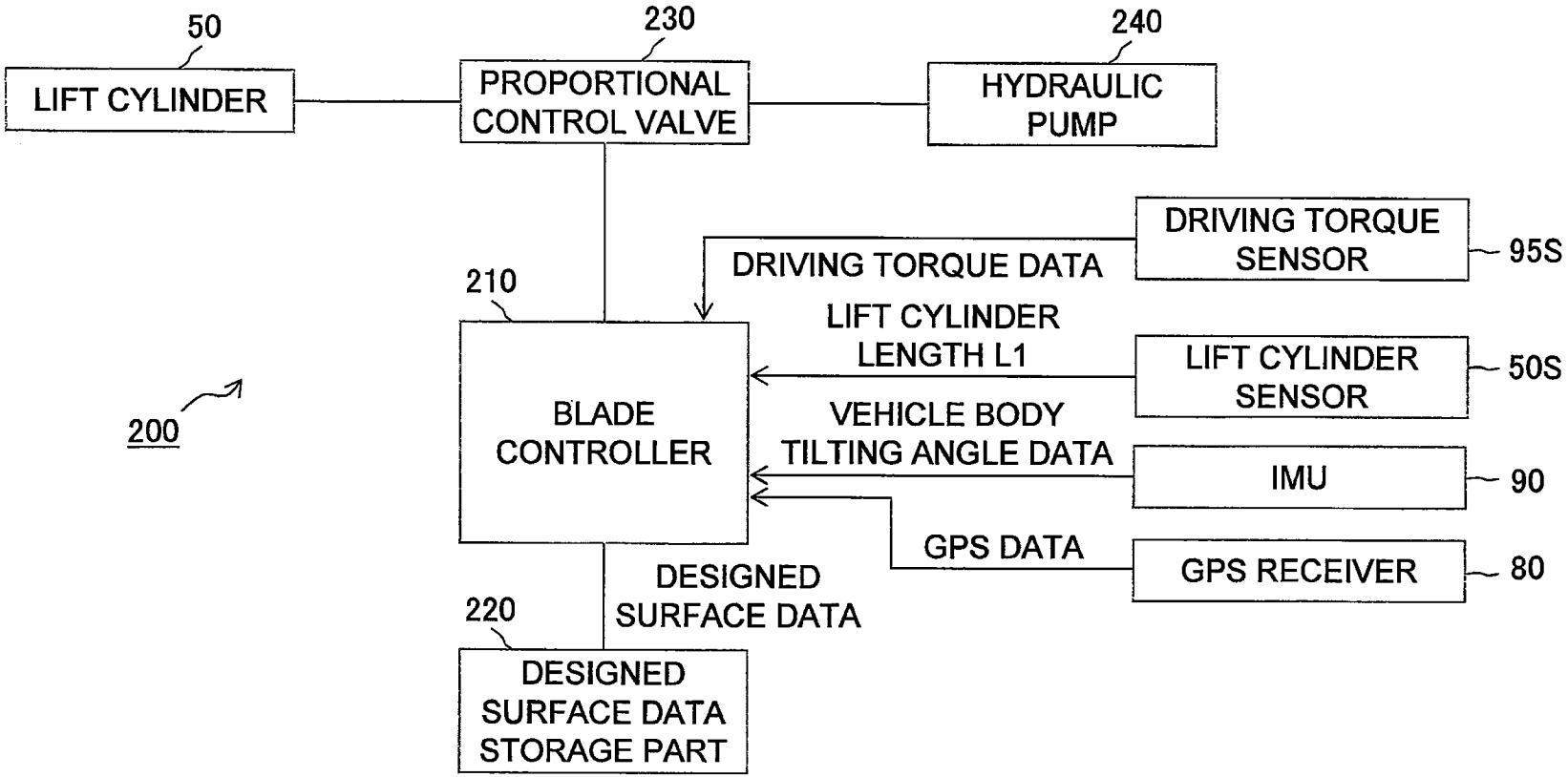
FIG. 3 is a configuration block diagram of a blade control system.

FIG. 3 is a configuration block diagram of the blade control system 200 according to the present exemplary embodiment.

The blade control system 200 includes the blade controller 210, a designed surface data storage 220, a proportional control valve 230 and a hydraulic pump 240 in addition to the aforementioned elements including the lift cylinder 50, the lift cylinder sensor 50S, the GPS receiver 80, the IMU 90 and the driving torque sensor 95S.

The blade controller 210 is configured to obtain the lift cylinder length L1 from the lift cylinder sensor 50S. Further, the blade controller 210 is configured to obtain the GPS data from the GPS receiver 80, obtain the vehicle body tilting angle data from the IMU 90, and obtain the driving torque data from the driving torque sensor 95S. The blade controller 210 is configured to output electric current which corresponds to an electric current value obtained based on the above information as a control signal to the proportional control valve 230. Functions of the blade controller 210 will be hereinafter described.

The designed surface data storage 220 has been preliminarily stored designed surface data indicating the position and the shape of a three-dimensionally designed landform (hereinafter referred to as "a designed surface M"), which indicates a target shape of an object for dozing within a work area.

The proportional control valve 230 is disposed between the lift cylinder 50 and the hydraulic pump 240. The open ratio of the proportional control valve 230 is configured to be controlled by the electric current outputted from the blade controller 210 as a control signal.

The hydraulic pump 240 is configured to be operated in conjunction with the engine, and the hydraulic pump 240 is configured to supply hydraulic oil to the lift cylinder 50 via the proportional control valve 230. It should be noted that the hydraulic pump 240 can supply the hydraulic oil to the angling cylinder 60 and the tilt cylinder 70 via proportional control valves different from the proportional control valve 230.

Functions of Blade Controller 210

Figure 4:
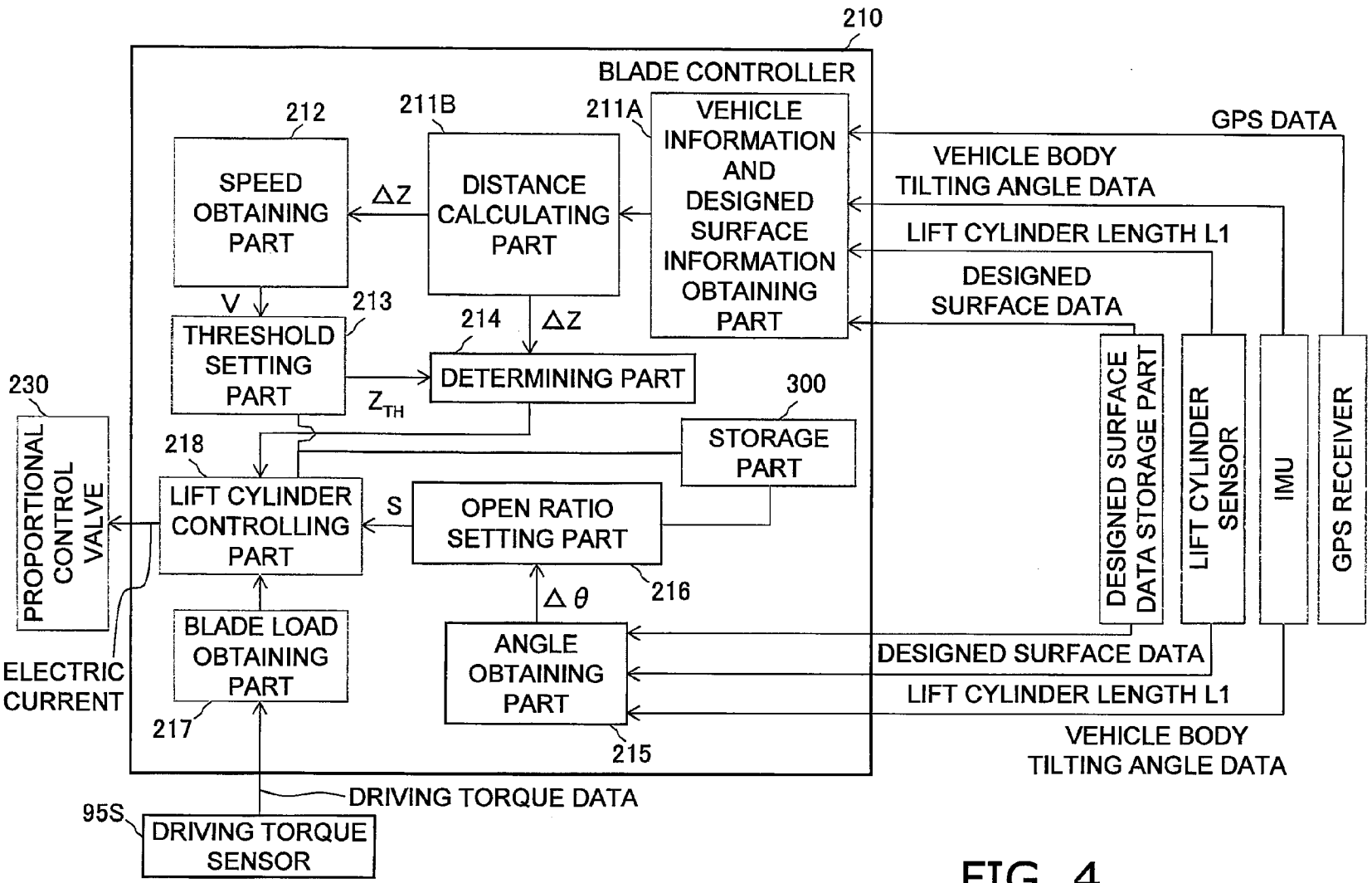
FIG. 4 is a functional block diagram of a blade controller.
Figure 5:
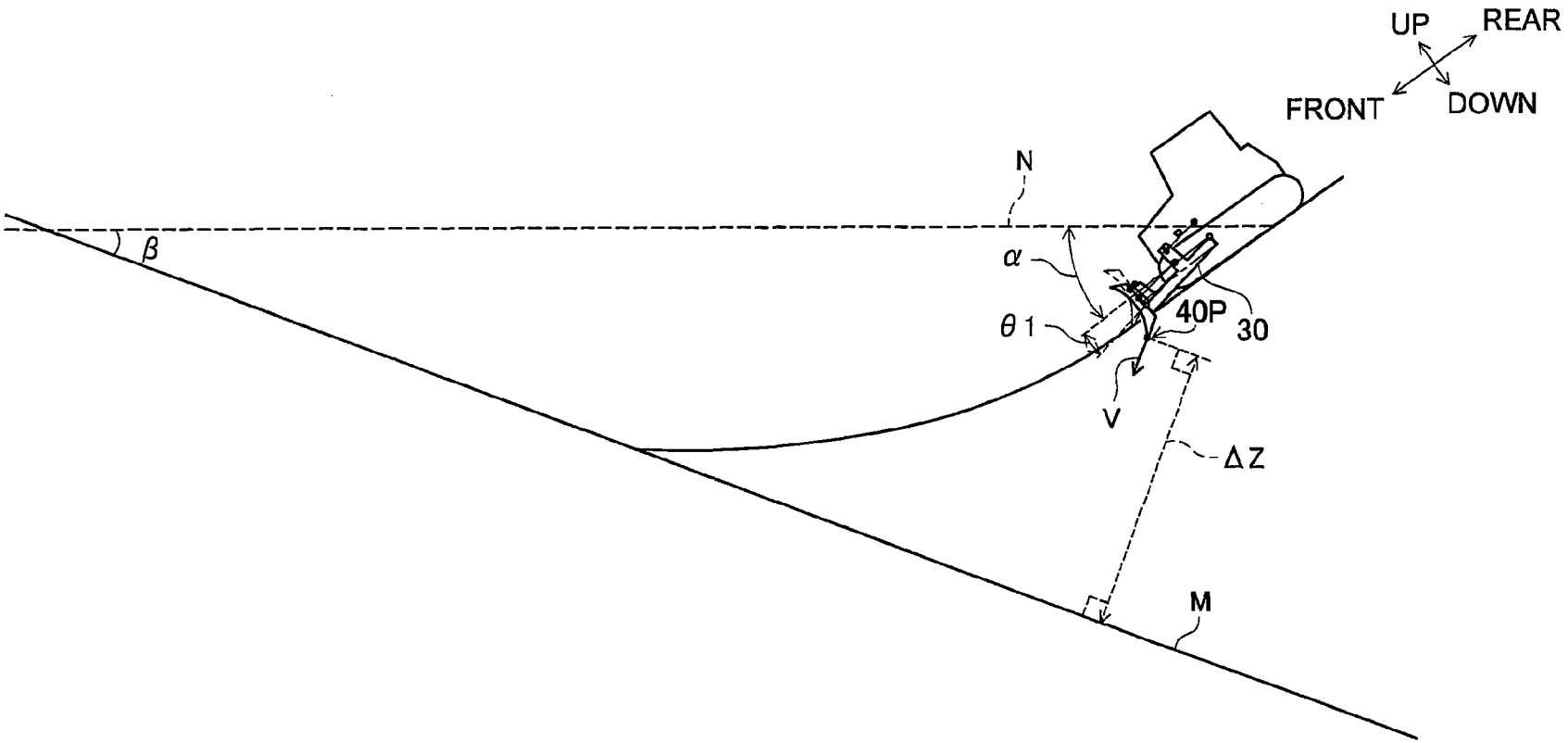
FIG. 5 is a schematic diagram of an exemplary positional relation between the bulldozer and a designed surface.
Figure 6:
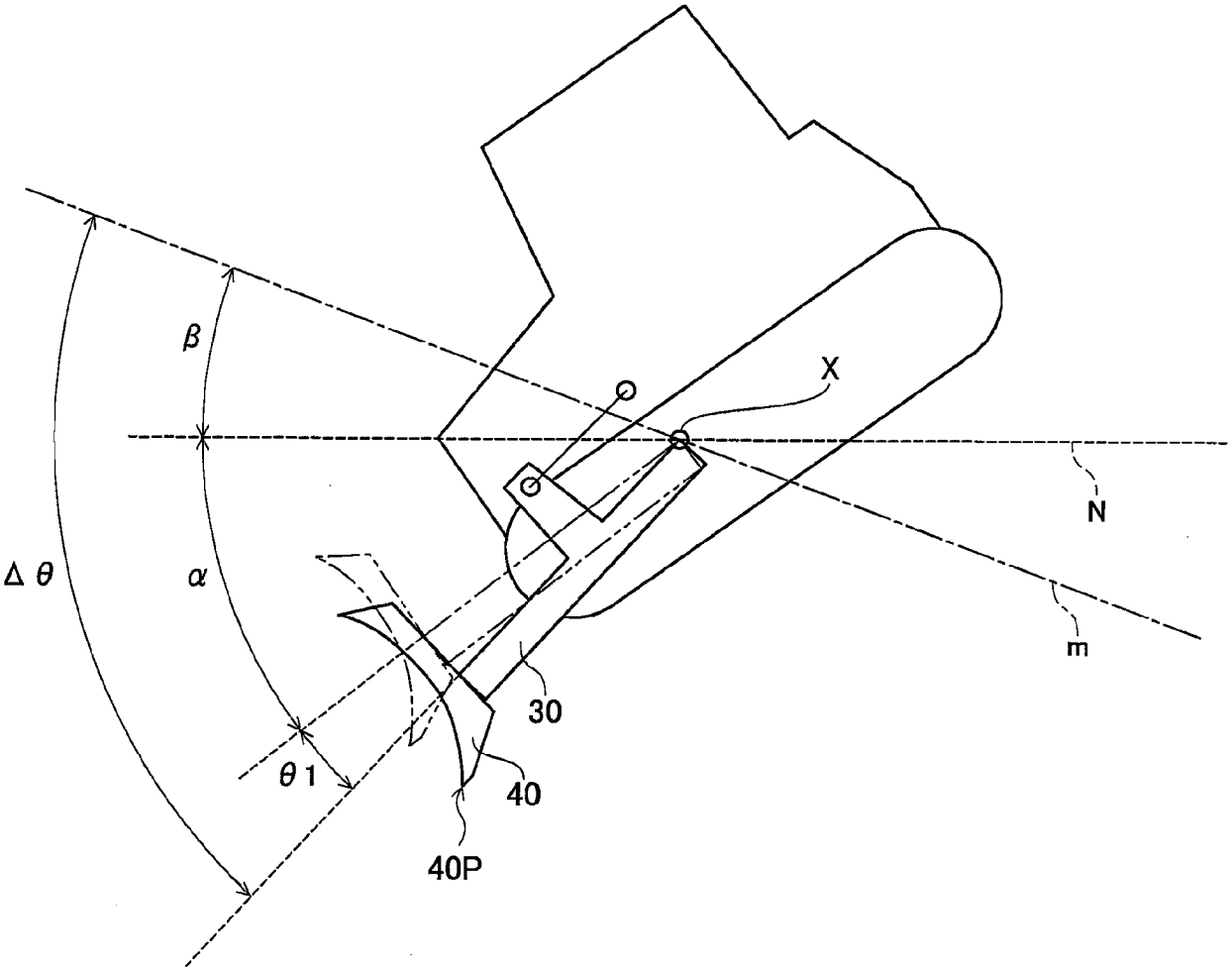
FIG. 6 is a partially enlarged view of FIG. 5.

FIG. 4 is a functional block diagram of the blade controller 210. FIG. 5 is a schematic diagram for illustrating an exemplary positional relation between the bulldozer 100 and the designed surface M. FIG. 6 is a partially enlarged view of FIG. 5.

As represented in FIG. 4, the blade controller 210 includes a vehicle information and designed surface information obtaining part 211A, a distance calculating part 211B, a speed obtaining part 212, a threshold setting part 213, a determining part 214, an angle obtaining part 215, an open ratio setting part 216, a blade load obtaining part 217, a lift cylinder controlling part 218 and a storage part 300.

The vehicle information and designed surface information obtaining part 211A is configured to obtain the lift cylinder length L1, the GPS data, the vehicle body tilting angle data and the designed surface data. In the present exemplary embodiment, the lift cylinder length L1, the GPS data and the vehicle body tilting angle data correspond to "vehicle information" whereas the designed surface data corresponds to "designed surface information".

The distance calculating part 212B stores vehicle body size data of the bulldozer 100. As illustrated in FIG. 5, the distance calculating part 212B is configured to obtain a distance ΔZ between the designed surface M and the cutting edge 40P based on the lift cylinder length L1, the GPS data, the vehicle body tilting angle data, the designed surface data and the vehicle body size data either on a real time basis or at predetermined time intervals. It should be noted that the predetermined time interval herein refers to, for instance, timing corresponding to the processing speed of the blade controller 210. Specifically, the shortest sampling time is set to be 10 milliseconds (msec) where the processing speed of the blade controller 210 is set to be 100 Hz.

As illustrated in FIG. 5, the speed obtaining part 212 is configured to differentiate the distance ΔZ of the distance calculating part 211B by a sampling time Δt in order to obtain a speed V of the cutting edge 40P with respect to the designed surface M. In other words, the relation "V=ΔZ/Δt" is established.

Figure 7:
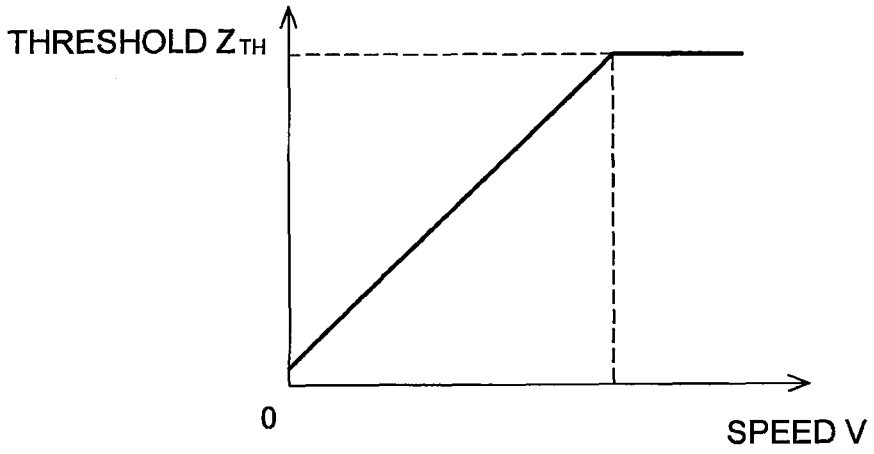
FIG. 7 is a chart representing an exemplary relation between speed and threshold.
Figure 8:
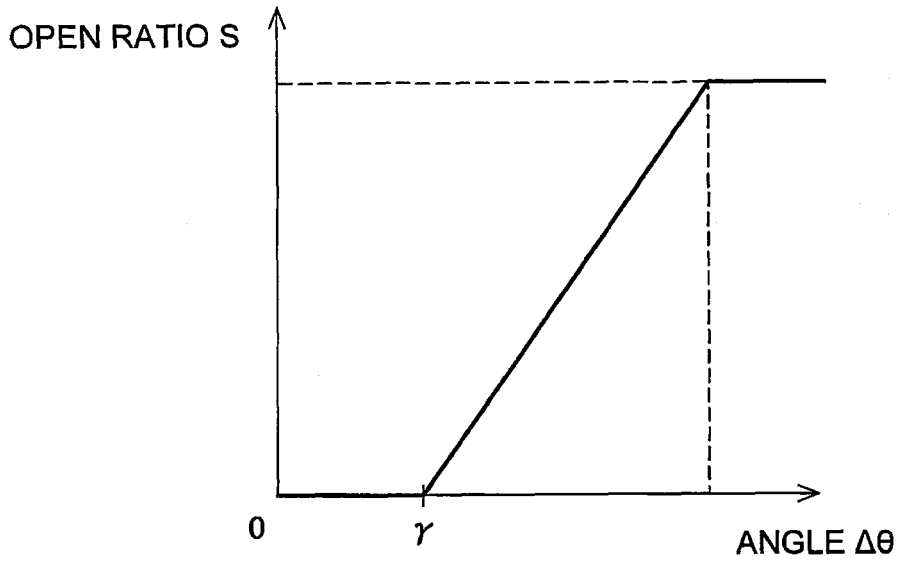
FIG. 8 is a chart representing an exemplary relation between angle and open ratio.

The storage part 300 stores a variety of maps used for controls by the blade controller 210. For example, the storage part 300 stores a map of FIG. 7 representing "relation between speed V and threshold $Z_{TH}$" and a map of FIG. 8 representing "relation between angle Δθ and open ratio S". The threshold $Z_{TH}$, the angle Δθ and the open ratio S will be hereinafter described.

Further, the storage part 300 stores a target load set as a target value of load acting on the blade 40 (hereinafter referred to as "a blade load"). The target load has been preliminarily set in consideration of balance between the dozing amount and slippage of the tracks of the drive unit against the ground (hereinafter referred to as "shoe slippage"), and the target load can be arbitrarily set to be in a range from 0.5 to 0.7 times as much as the vehicle weight W of the bulldozer 100.

It should be noted that excessive shoe slippage hereinafter refers to a condition that driving force of the drive unit cannot be appropriately transmitted to the ground due to an excessively increased amount of slippage of the tracks against the ground.

The threshold setting part 213 is configured to retrieve the map indicating "relation between speed V and threshold $Z_{TH}$" from the storage part 300 and set the threshold $Z_{TH}$ of the distance ΔZ based on the speed V obtained by the speed obtaining part 212. The threshold $Z_{TH}$ is set for reliably elevating the blade 40 even when the cutting edge 40P approaches, the designed surface M at a high speed. As represented in FIG. 7, magnitude of the threshold $Z_{TH}$ is increased in proportion to magnitude of the speed V. The threshold $Z_{TH}$ is set to be maximized where the speed V is greater than or equal to a predetermined value.

The determining part 214 is configured to access the map and retrieve the threshold $Z_{TH}$ therefrom and determine whether or not the distance ΔZ obtained by the distance calculating part 211B is less than or equal to the threshold $Z_{TH}$ set by the threshold setting part 213. When determining that the distance ΔZ is less than or equal to the threshold $Z_{TH}$, the determining part 214 is configured to inform the lift cylinder controlling part 218 of the decision result.

The angle obtaining part 215 is configured to obtain the lift cylinder length L1, the vehicle body tilting angle data and the designed surface data. The angle obtaining part 215 is configured to calculate the blade lifting angle θ1 of the blade 40 based on the lift cylinder length L1.

Figure 9:
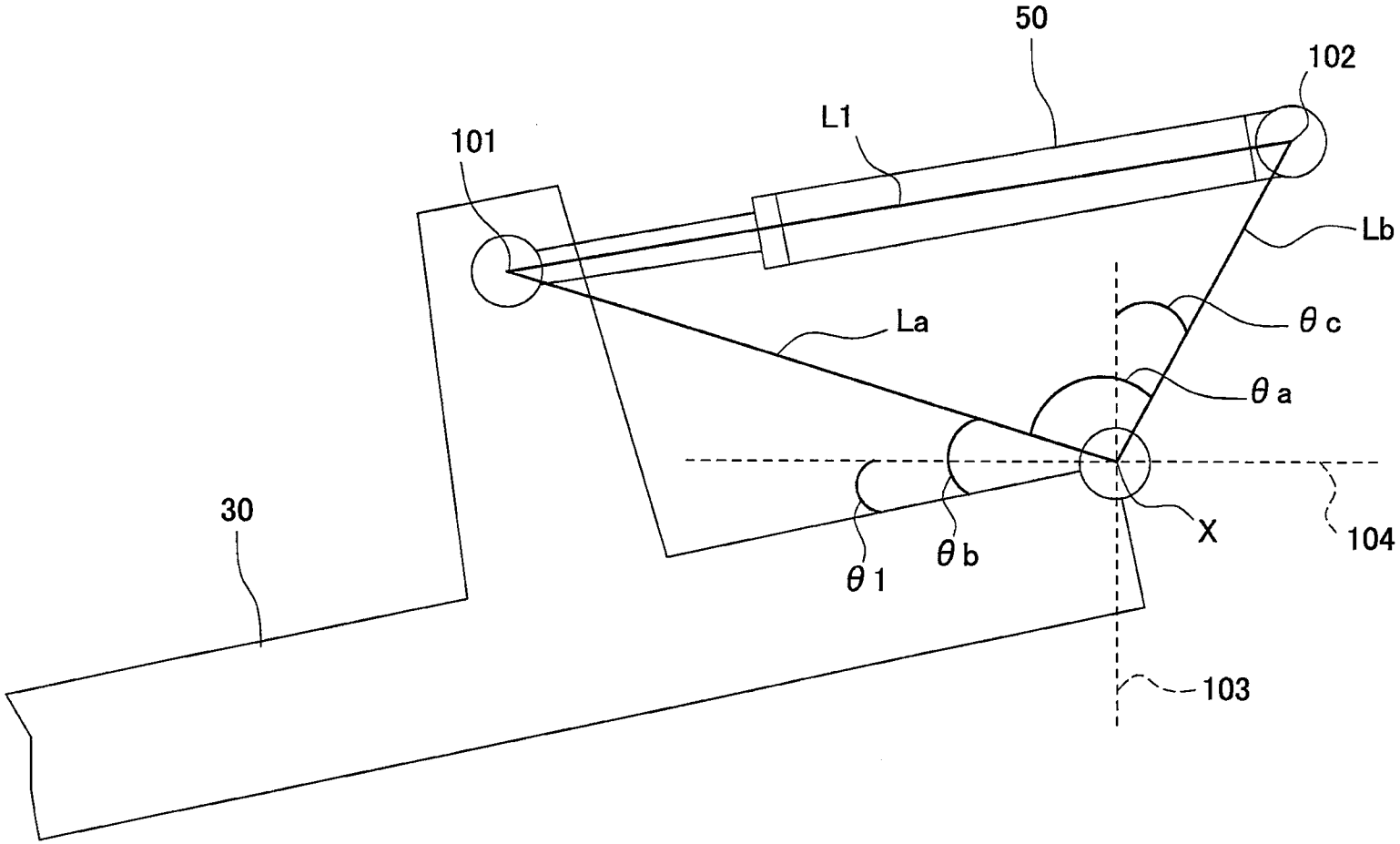
FIG. 9 is a schematic diagram for explaining a method of calculating a blade lifting angle.

Now, FIG. 9 is a partially enlarged view of FIG. 2A and schematically explains a method of calculating the blade lifting angle θ1. As represented in FIG. 9, the lift cylinder 50 is attached to the lift frame 30 while being rotatable about a front-side rotary axis 101, and the lift cylinder 50 is attached to the vehicle body 10 while being rotatable about a rear-side rotary axis 102. In FIG. 9, a vertical line 103 is a straight line arranged along the vertical direction, and an original position indicating line 104 is a straight line indicating the original position of the blade 40. Further, a first length La is the length of a straight line segment connecting the front-side rotary axis 101 and an axis X of the lift frame 30, and a second length Lb is the length of a straight line segment connecting the rear-side rotary axis 102 and the axis X of the lift frame 30. Further, a first angle θa is formed between the front-side rotary axis 101 and the rear-side rotary axis 102 around the axis X as the vertex of the first angle θa, and a second angle θb is formed between and the front-side rotary axis 101 and the upper face of the lift frame 30 around the axis X as the vertex of the first angle θb, and a third angle θc is formed between the rear-side rotary axis 102 and the vertical line 103 around the axis X as the vertex of the first angle θc. The first length La, the second length Lb, the second angle θb and the third angle θc are fixed values and are stored in the angle obtaining part 210. Radian is herein set as the unit for the second angle θb and that of the third angle θc.

[First, the angle obtaining part 210 is configured to calculate the first angle θa using the following equations (1) and (2) based on the law of cosines.

$$L1^2=La^2+Lb^2-2LaLb\times\cos(\theta a) \quad (1)$$

$$\theta a=\cos^{-1}((La^2+Lb^2-L1^2)/2LaLb) \quad (2)$$

Next, the angle obtaining part 215 is configured to calculate the blade lifting angle θ1 using the following equation (3).

$$\theta 1=\theta a+\theta b-\theta c-\pi/2 \quad (3)$$

Further, the angle obtaining part 215 is configured to obtain a lift frame tilting angle α based on the vehicle body tilting angle data, and the lift frame tilting angle α is herein set as an angle formed by a horizontal plane N and the origin position of the lift frame 30 in a side view. The angle obtaining part 215 is also configured to obtain a designed surface tilting angle β based on the designed surface data, and the designed surface tilting angle β is herein set as an angle formed by the designed surface M and the horizontal plane N.

Yet further, the angle obtaining part 215 is configured to obtain sum of the blade lifting angle θ1, the lift frame tilting angle α and the designed surface tilting angle β. As illustrated in a side view of FIG. 6, the sum of the blade lifting angle θ1, the lift frame tilting angle α and the designed surface tilting angle β corresponds to the angle Δθ of the lift frame 30 with respect to the designed surface M (note FIG. 6 depicts, as the designed surface M, a parallel surface m arranged in parallel to the designed surface M). In other words, the relation "Δθ=θ1+α+β" is established.

The open ratio setting part 216 is configured to set the open ratio S of the proportional control valve 230 based on the angle Δθ. Specifically, the open ratio setting part 216 is configured to determine whether or not the angle Δθ is greater than a target angle γ. The target angle γ is herein set as a value for causing the cutting edge 40P to reliably move across the designed surface M even when the vehicle speed is fast and/or the vehicle body angle largely varies. In other words, when the angle Δθ is less than the target angle γ, the cutting edge 40P is not shoved across the designed surface M into the ground regardless of the vehicle speed or variation in the vehicle body angle. Thus configured target angle γ can be arbitrarily set and changed. When the angle Δθ is not greater than the target angle γ, the open ratio setting part 216 is configured to set the open ratio S to be "0". When the angle Δθ is greater than the target angle γ, by contrast, the open ratio setting part 216 is configured to retrieve a map representing "relation between angle Δθ and open ratio S" represented in FIG. 8 from the storage part 300 and set a value of the open ratio S to be matched with a value of the angle Δθ based on the relational map. As represented in FIG. 8, magnitude of the open ratio S is increased in proportion to magnitude of the angle Δθ, and the open ratio S is set to be maximized where the angle Δθ is greater than or equal to a predetermined value. The open ratio setting part 216 is configured to inform the lift cylinder controlling part 218 of the set open ratio S.

The blade load obtaining part 217 is configured to obtain the driving torque data, indicating the driving torque of the pair of sprocket wheels 95, from the driving torque sensor 95S on a real-time basis. Further, the blade load obtaining part 217 is configured to obtain a blade load based on the driving torque data. The blade load corresponds to so-called "traction force". The blade load obtaining part 217 is configured to inform the lift cylinder controlling part 218 of the obtained blade load.

The lift cylinder controlling part 218 is configured to control the proportional control valve 230 at the open ratio S set by the open ratio setting part 216 and thereby supply the hydraulic oil to the lift cylinder 50 for elevating the blade 40 when the determining part 214 determines that the distance ΔZ is less than or equal to the threshold $Z_{TH}$. Therefore, when the angle Δθ is greater than the target angle γ, the lift cylinder controlling part 218 is configured to elevate the blade 40 at a higher speed in proportion to magnitude of the angle Δθ. When the angle Δθ is not so large, the speed for elevating the blade 40 is not so fast. When the angle Δθ is not greater than the target angle γ, by contrast, the lift cylinder controlling part 218 is configured to set the open ratio S to be "0" for preventing the blade 40 from being lifted up.

Further, when the determining part 214 does not determine that the distance ΔZ is less than or equal to the threshold $Z_{TH}$, the lift cylinder controlling part 218 is configured to control the open ratio of the proportional control valve 230 for allowing the blade load obtained by the blade load obtaining part 217 to get closer to the target load.

Specifically, the lift cylinder controlling part 218 is firstly configured to calculate a difference between the target load and the blade load (hereinafter referred to as "a load deviation"). Next, the lift cylinder controlling part 218 is configured to obtain an electric current value by either substituting the load deviation in a predetermined function or referring to a map representing relation between load deviation and electric current values. Next, the lift cylinder controlling part 218 is configured to output electric current, corresponding to the obtained electric current value, to the proportional control valve 230. Accordingly, the open ratio of the proportional control valve 230 is controlled for allowing the blade load to get closer to the target load, then dozing is executed under the condition that excessive shoe slippage of the drive unit 20 is inhibited, and simultaneously, the dozing amount is sufficiently maintained.

Actions of Blade Control System 200

Figure 10:
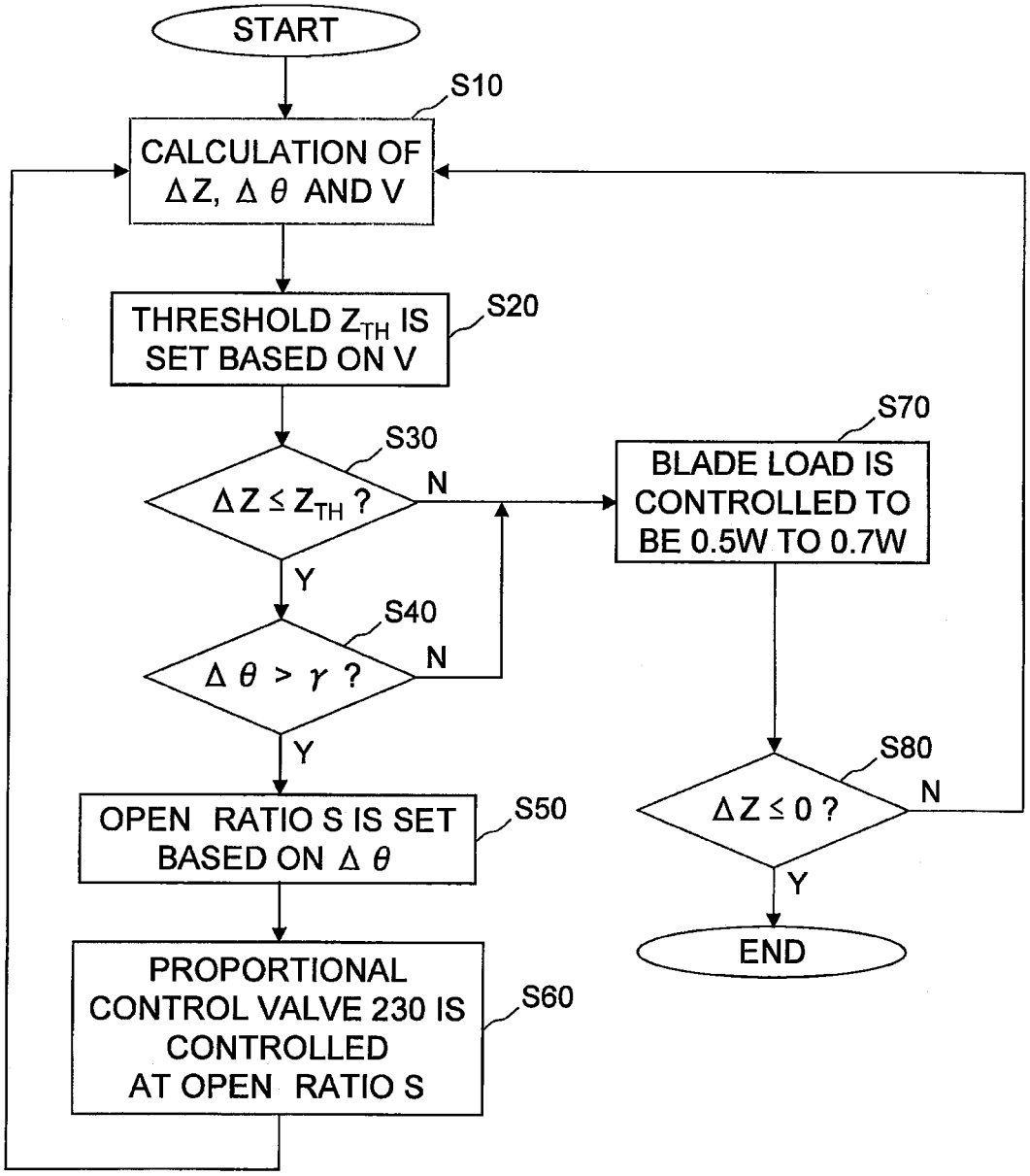
FIG. 10 is a flowchart for explaining actions of the blade control system.

FIG. 10 is a flowchart for explaining the actions of the blade control system 200 according to an exemplary embodiment of the present invention. It should be noted that the following explanation mainly focuses on the actions of the blade controller 210.

In Step S10, the blade controller 210 obtains the distance ΔZ based on the lift cylinder length L1, the GPS data, the vehicle body tilting angle data, the designed surface data and the vehicle body size data. Simultaneously, the blade controller 210 obtains the speed V based on the distance ΔZ and obtains the angle Δθ based on the lift cylinder length L1, the vehicle body tilting angle data and the designed surface data.

In Step S20, the blade controller 210 sets the threshold $Z_{TH}$ of the distance ΔZ based on the speed V.

In Step S30, the blade controller 210 determines whether or not the distance ΔZ is less than or equal to the threshold $Z_{TH}$. The processing proceeds to Step S40 when the blade controller 210 determines that the distance ΔZ is less than or equal to the threshold $Z_{TH}$, by contrast, the processing proceeds to Step S70 when the blade controller 210 determines that the distance ΔZ is not less than or equal to the threshold $Z_{TH}$.

In Step S40, the blade controller 210 determines whether or not the angle Δθ is greater than the target angle γ. The processing proceeds to Step S50 when the blade controller 210 determines that the angle Δθ is greater than the target angle γ, by contrast, the processing proceeds to Step S70 when the blade controller 210 determines that the angle Δθ is not grater than the target angle γ.

In Step S50, the blade controller 210 determines the open ratio S of the proportional control valve 230 based on the angle Δθ.

In Step S60, the blade controller 210 outputs a control signal to the proportional control valve 230 for controlling the proportional control valve 230 at the open ratio S. Subsequently, the processing returns to Step S10.

In Step S70, the blade controller 210 controls the open ratio of the proportional control valve 230 for allowing the blade load to fall in a range of 0.5 W to 0.7 W. The blade controller 210 sets an electric current value for allowing the blade load to get closer to the target load and outputs electric current corresponding to the set electric current value to the proportional control valve 230.

In Step S80, the blade controller 210 determines whether or not the distance ΔZ is less than or equal to "0". The processing ends when the blade controller 210 determines that the distance ΔZ is less than or equal to "0", by contrast, the processing returns to Step S10 when the blade controller 210 determines that the distance ΔZ is not less than or equal to "0".

Working Effects (1) In the present exemplary embodiment, the blade control system 200 includes the angle obtaining part 215 which is configured to obtain the angle Δθ of the lift frame with respect to the designed surface M, the open ratio setting part 216 which is configured to set the open ratio S based on the angle Δθ and the lift cylinder controlling part 218 which is configured to open the proportional control valve 230 at the open ratio S for elevating the blade 40 when the distance ΔZ is determined to be less than or equal to the threshold $Z_{TH}$.

Thus, the blade 40 is configured to be elevated at a higher speed in proportion to magnitude of the angle Δθ. It is thereby possible to inhibit the cutting edge 40P from being shoved across the designed surface M into the ground. In other words, it is possible to cause the cutting edge 40P of the blade 40 to accurately move across the designed surface M.

When the angle Δθ is not so large, by contrast, the speed for elevating the blade 40 is not so fast, then it is possible to reliably doze a predetermined amount of earth and sand without leaving a required amount of earth and sand undozed.

(2) In the present exemplary embodiment, the blade control system 200 includes the speed obtaining part 212 which is configured to obtain the speed V based on the distance ΔZ and the threshold setting part 213 which is configured to obtain the speed V based on the distance ΔZ. The threshold setting part 213 is configured to set the threshold value $Z_{TH}$ to be used for the determining part 214 based on the speed V.

Therefore, the timing of starting elevation of the blade 40 can be set ahead in proportion to magnitude of the speed of the blade 40 approaching the designed surface M. It is thereby possible to inhibit the cutting edge 40P from being shoved across the designed surface M into the ground even when the distance ΔZ between the cutting edge 40P and the designed surface M is abruptly reduced. According to the blade control system 200 of the present exemplary embodiment, it is possible to cause the cutting edge 40P of the blade 40 to more accurately move across the designed surface M.

(3) The lift cylinder controlling part 218 is configured to prevent elevation of the blade 40 when the lift frame 30 is positioned higher than a position (an exemplary "predetermined position") that is higher than the original position by the designed surface tilting angle in a side view.

Therefore, it is possible to execute the control of setting ahead the timing of starting elevation of the blade 40 only when chances are that the cutting edge 40P is shoved across the designed surface M into the ground. In other words, it is possible to inhibit the control of setting ahead the timing of starting elevation of the blade 40 from being excessively executed.

Other Exemplary Embodiments

An exemplary embodiment of the present invention has been explained above, but the present invention is not limited to the aforementioned exemplary embodiment, and a variety of changes can be herein made without departing from the scope of the present invention.

(A) In the aforementioned exemplary embodiment, the blade control system 200 includes the angle obtaining part 215 and the open ratio setting part 216, but the components forming the blade control system 200 are not limited to the above. For example, the blade control system 200 may not include the angle obtaining part 215 and the open ratio setting part 216 when the proportional control valve 230 is configured to be controlled with a predetermined open ratio.

(B) In the aforementioned exemplary embodiment, the blade control system 200 includes the speed obtaining part 212 and the threshold setting part 213, but the components forming the blade control system 200 are not be limited to the above. For example, the blade control system 200 may not include the speed obtaining part 212 and the threshold setting part 213 when the determining part 214 is configured to use a preliminarily stored fixed value/values as the threshold $Z_{TH}$.

(C) In the aforementioned exemplary embodiment, the lift cylinder controlling part 218 is configured to control the blade load to be in a range of 0.5 W to 0.7 W, but the configuration of the blade load is not limited to the above. The blade load may be arbitrarily changed depending on factors such as hardness of an object for dozing. Further, the blade load can be obtained, for instance, by multiplying an engine torque by a sprocket diameter and a reduction ratio to a transmission, a steering mechanism and a final reduction gear.

(D) In the aforementioned exemplary embodiment, FIG. 7 represents an exemplary relation between the speed V and the threshold Z while FIG. 8 represents an exemplary relation between the angle Δθ and the opening degree S, but the configuration of the blade load is not limited to the above. The configurations of the relations are not limited to the above and may be arbitrarily set.

(E) The cutting edge 40P of the blade 40 may be defined as either the right end thereof or the left end thereof, by contrast, the cutting edge 40P may be defined as the transverse center thereof.

(F) In the aforementioned exemplary embodiment, the control is configured to be executed only based on the single cutting edge 40P of the blade 40, but the control explained in the aforementioned exemplary embodiment may be configured to be executed based on each of the right and left ends of the cutting edge 40P of the blade 40. In this case, it is possible to cause the cutting edge 40P to accurately move across the designed surface even when the vehicle body is slanted rightwards or leftwards.

(G) In the aforementioned exemplary embodiment, as represented in FIG. 7, the threshold Z is configured to be fixed to the maximum value when the speed V is greater than or equal to a predetermined value, but the setting of the threshold $Z_{TH}$ is not limited to the above. For example, the threshold $Z_{TH}$ may not have the maximum value setting.

What is claimed is:

1. A bulldozer blade control system comprising:

a lift frame vertically pivotably attached to a bulldozer vehicle body;

a blade supported by a frontward tip of the lift frame, the blade extending in a right-and-left direction of the bulldozer vehicle body;

a lift cylinder configured to vertically pivot the lift frame;

a proportional control valve connected to the lift cylinder;

a lifting angle obtaining part configured to obtain a lifting angle of the lift frame with respect to a designed surface in a side view of the bulldozer vehicle body, the designed surface formed as a three-dimensionally designed landform indicating a target contour of an object for dozing;

an open ratio setting part configured to set an open ratio of the proportional control valve based on the lifting angle;

a distance calculating part configured to calculate a distance between the designed surface and a cutting edge of the blade;

a determining part configured to determine whether or not the distance between the designed surface and the cutting edge of the blade is less than or equal to a threshold; and a lift cylinder controlling part configured to open the proportional control valve at the open ratio set by the open ratio setting part for elevating the blade when the determining part determines that the distance between the designed surface and the cutting edge of the blade is less than or equal to the threshold.

2. The bulldozer blade control system according to claim 1, wherein the open ratio setting part is configured to increase the open ratio of the proportional control valve in proportion to magnitude of the lifting angle of the lift frame with respect to the designed surface.

3. The bulldozer blade control system according to claim 2, wherein the open ratio setting part is configured to fix the open ratio of the proportional control valve to be a maximum value when the lifting angle of the lift frame with respect to the designed surface is greater than or equal to a predetermined value.

4. The bulldozer blade control system according to claim 1, wherein the lift cylinder controlling part is configured to prevent elevation of the blade when the lift frame is positioned higher than a predetermined position.

5. The bulldozer blade control system according to claim 1, further comprising:

a blade load obtaining part configured to obtain a load acting on the blade; and a storage part configured to store a target load preliminarily set, wherein the lift cylinder controlling part is configured to control the open ratio of the proportional control valve for allowing the load to get closer to the target load when the determining part determines that the distance between the designed surface and the cutting edge of the blade is greater than the threshold.

6. A bulldozer, comprising:

a bulldozer vehicle body; and the blade control system according to claim 1.

7. The bulldozer according to claim 6, further comprising:

a drive unit including a pair of tracks attached to the bulldozer vehicle body.

8. The bulldozer blade control system according to claim 1, wherein the lift frame extends from a position rearward of a front end of the bulldozer vehicle body to a position frontward of the front end of the bulldozer vehicle body in a longitudinal direction of the bulldozer vehicle body, the lift frame being arranged to pivot about a pivot axis disposed rearward of the front end of the bulldozer vehicle body, the pivot axis extending in a transverse direction of the bulldozer vehicle body, the lifting angle corresponds to an angular pivot amount of the lift frame about the pivot axis with respect to a reference position of the lift frame.

9. The bulldozer blade control system according to claim 1, wherein the blade has an elongated shape in the right-and-left direction of the bulldozer vehicle body, and a rearward side of the blade is operatively coupled to the frontward tip of the lift frame, and a frontward side of the blade opposite the rearward side is curved, the frontward side of the blade being curved such that an upper edge and a lower edge of the blade are disposed farther from the lift frame than a middle portion of the frontward side disposed between the upper and lower edges.

* * * * *